US006520740B1

(12) United States Patent
Williams

(10) Patent No.: US 6,520,740 B1
(45) Date of Patent: Feb. 18, 2003

(54) ENERGY EFFICIENT FAN

(76) Inventor: Gregory M. Williams, 700 S. Ocean Blvd., Apt. 602, Boca Raton, FL (US) 33432

( * ) Notice: Subject to any disclaimer, the term of this patent is extended or adjusted under 35 U.S.C. 154(b) by 0 days.

(21) Appl. No.: 10/016,876

(22) Filed: Dec. 14, 2001

(51) Int. Cl.[7] ..... F04D 29/20

(52) U.S. Cl. ..... 416/139; 416/170 R; 416/175; 416/199; 416/203; 415/122.1

(58) Field of Search ..... 415/122.1, 125; 416/122, 128, 170 R, 175, 199, 203, 139; 446/31, 61, 68, 217, 218

(56) References Cited

U.S. PATENT DOCUMENTS 1,910,923 A * 5/1933 Kerr ..... 446/217

2,222,444 A * 11/1940 Schmidt et al. ..... 416/203

* cited by examiner

*Primary Examiner*—Ninh Nguyen
(74) *Attorney, Agent, or Firm*—Robert Downey, P.A.

(57) ABSTRACT

One or more fan blades extend radially from a hub that is freely rotatable relative to a main drive shaft. The hub is coupled to the drive shaft so that, when the drive shaft is moved through an orbital path in a cyclical motion, the hub moves in a twirling action. As the hub twirls, a weighted distal end of the blade travels through an arcuate path to generate angular momentum sufficient to carry the blade through an uninterrupted rotational motion. The fan blade is structured and disposed to push a large volume of air as it rotates, thereby creating a steady current of airflow with minimal energy consumption.

7 Claims, 3 Drawing Sheets

FIG. 1
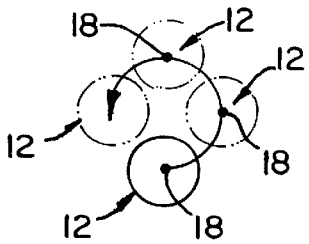
FIG. 1A
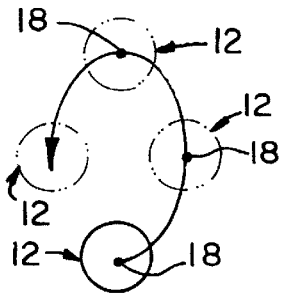
FIG. 3
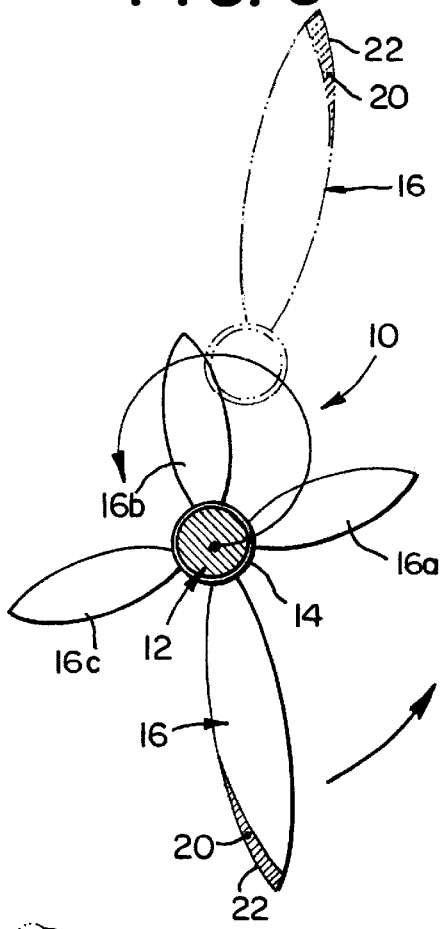
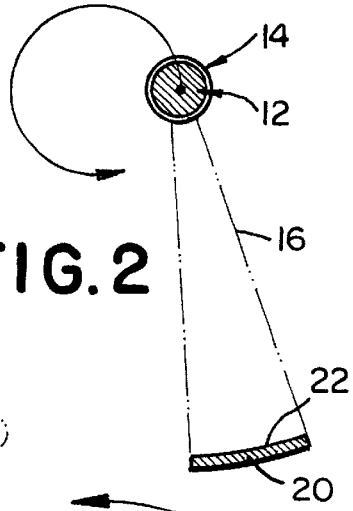
FIG. 2
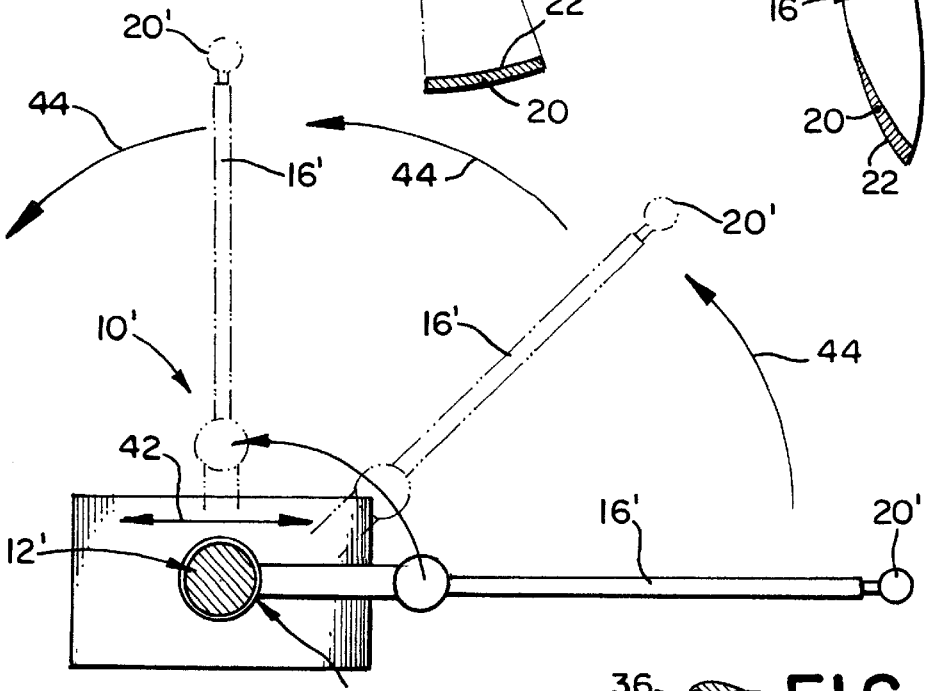
FIG. 5
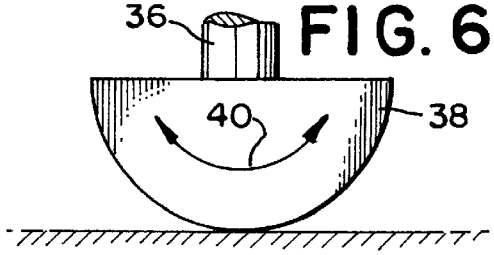
FIG. 6

ENERGY EFFICIENT FAN

BACKGROUND OF THE INVENTION

1. Field of the Invention

The present invention relates to energy efficient fans and, more particularly, to an energy efficient fan having one or more fan blades fixed to a hub which is freely rotatable relative to a central drive shaft, and wherein twirling of the hub creates angular momentum of the fan blade which carries the blade through a continuous 360° rotational motion, thereby pushing a current of airflow.

2. Discussion of the Related Art

Motorized fans of various types are well known in the art. Typically, a hub is fixed to the end of a shaft which is rotatably driven by a motor. Several fan blades are fixed to the hub and pitched at an angle to move air as the hub and blades rotate. The amount of power required to drive the shaft and rotate the hub and blades at a specific RPM is primarily dependent on the size of the blades (i.e. surface area and length) as well as the pitch of the blades. More specifically, a significant amount of electrical energy is required to overcome the torque which is generated by the resistance of the fan blades when rotating, particularly at higher speeds. For this reason, the operation of electrically powered motorized fans, particularly those having a relatively large fan blade length or radius, can be costly when operating at higher RPMs. Accordingly, there remains a need in the fan art for an energy efficient fan which rotates one or more fan blades at a high RPM while consuming less energy than conventional motorized fans.

SUMMARY OF THE INVENTION

According to the present invention, one or more fan blades are fixed to a hub which is freely rotatable relative to a main drive shaft. In one embodiment, the inner circumference of the hub is greater than the outer circumference of the drive shaft so that when the shaft is moved in a cyclical motion, and the central longitudinal axis of the shaft travels through a continuous orbital path, the hub moves in a twirling action about the shaft. As the hub twirls, a weighted distal end of the blade travels through an arcuate path to generate angular momentum which is sufficient to carry the blade through an uninterrupted rotational motion, thereby resulting in rotation of the one or more fan blades. The fan blade is structured and disposed to push a large volume of air as it rotates, thereby creating a steady current of airflow with minimal energy consumption.

BRIEF DESCRIPTION OF THE DRAWINGS

For a fuller understanding of the nature of the present invention, reference should be made to the following detailed description taken in conjunction with the accompanying drawings in which:

FIG. 1 is a diagram illustrating an orbital path of the longitudinal axis of a drive shaft in accordance with one preferred mode of operation of the energy efficient fan of the present invention;

FIG. 1A is a diagram illustrating an alternative orbital path of the longitudinal axis of the drive shaft;

FIG. 2 is a diagram showing a hub and fan blade fitted about the shaft traveling through the orbital path of FIG. 1;

FIG. 3 is a top plan view, in partial phantom, illustrating motion of the fan blades through a circular rotational path upon movement of the shaft about the orbital path of FIG. 1;

FIG. 5 is a top plan view, in partial phantom, of the fan apparatus of FIG. 4, illustrating motion of a fan blade panel through a circular path;

FIG. 6 is an isolated front elevational view of the base of the fan apparatus of FIG. 4;

Like reference numerals refer to like parts throughout the several views of the drawings.

DETAILED DESCRIPTION OF THE PREFERRED EMBODIMENTS

Figure 4:
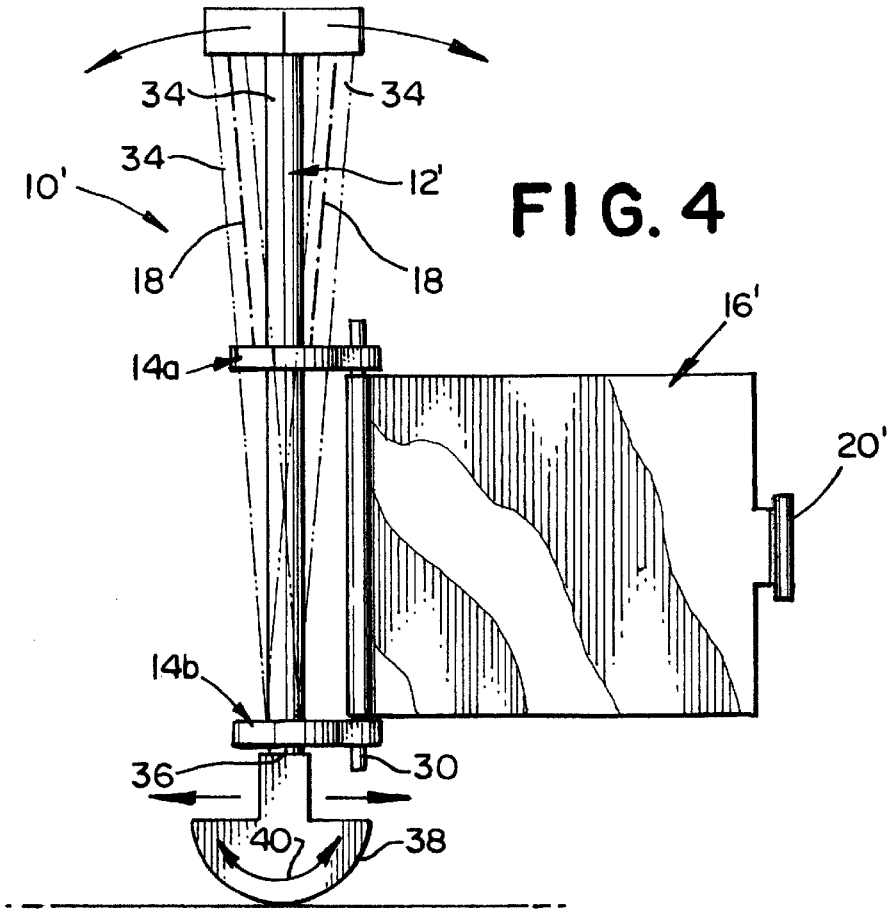
FIG. 4 is a front elevational view of an embodiment of the energy efficient fan of the present invention.

Referring to the several views of the drawings which illustrate the principal of operation of the energy efficient fan 10 of the present invention and several embodiments thereof, there is provided a main drive shaft 12 and a hub 14 freely rotatable relative to the shaft. At least one primary fan blade or panel 16 is fixed to the hub 14 and rotatable therewith so that, as the hub 14 spins about the shaft 12, the fan blade 16 is caused to travel through a circular path of rotation. The fan blade or panel 16 is specifically structured and configured to push a volume of air to create a current of airflow through a space upon rotation through the circular path. The hub 14 is loosely coupled to the shaft 12, and in one embodiment has an inner circumference which is larger than the outer circumference of the shaft. Movement of the shaft 12 through an orbital path causes the hub to twirl about the shaft 12 while spinning or rotating relative to the shaft.

Referring initially to FIG. 1, an orbital path of the drive shaft 12 is shown wherein the central longitudinal axis 18 of the shaft is shown to move through a generally circular and continuous path. FIG. 1A illustrates an alternative motion of the shaft, wherein the central longitudinal axis 18 moves through a generally elliptical path. It should be noted that the path through which the central axis 18 of the shaft 12 travels, as seen in FIGS. 1 and 1A, may occur at only one or both ends of the shaft. More particularly, one end of the shaft may be held relatively stationary, serving as a pivot, while the opposite end of the shaft is moved through the orbital path, such as that shown in FIGS. 1 and 1A. Alternatively, both ends of the shaft may be moved in unison through the same motion, so that the orbital path of the central longitudinal axis 18 is uniform along the entire length of the shaft 12.

Referring to FIG. 2, the hub 14 and fan blade 16 are shown coupled to the shaft 12 which is moving through a continuous orbital path. A weighted element 20 on the outer distal end 22 of the fan blade 16 provides angular momentum to carry the fan blade about the circular path of rotation as the hub 14 is twirled about the shaft 12. As seen in FIG. 3, the angular momentum generated by the weighted element 20 on the primary fan blade carries the entire fan blade assembly, including three secondary blades 16*a*, 16*b*, 16*c* fixed to the hub 14, through a circular path of rotation as the central axis 18 of the drive shaft moves through the orbital path and the hub freely rotates about the shaft.

Referring to FIGS. 4–6, one particular embodiment of a fan apparatus 10' is shown wherein a fan panel 16' is supported between upper and lower hub members 14*a* and

14*b*. The fan panel 16' is preferably formed of a flexible material such as fabric or a thin plastic film. The hub members 14*a*, 14*b* are fitted on vertical drive shaft 12' and are freely rotatable relative thereto. A rod 30 is fitted to the fan panel 16' and connects to the upper and lower hub members 14*a*, 14*b*. The rod 30 may be rotatable relative to the upper and lower hub members to promote free rotation of the fan panel 16' relative to the hub members and shaft. In operation, an upper end 34 of the shaft 12' is moved in a reciprocating back and forth motion, as indicated by the arrows in FIG. 4, while the bottom end of the shaft 36 pivots on a base 38. In this particular embodiment, the base is in the form of a rocker which is caused to rock back and forth in the direction of the arrow 40 shown in FIGS. 4 and 6. Upon movement of the central axis of the upper end of the shaft 12' in the reciprocating continuous motion, as indicated by the arrow 42 in FIG. 5, a weighted element 20' on the outer edge of the fan panel is thrown in a direction to create angular momentum. The angular momentum created by movement of the weighted element 20' carries the fan panel 16' about a circular path of rotation as shown by the arrows 44 in FIG. 5, while the hub members 14*a*, 14*b* freely rotate about the shaft 12'. Continuous back and forth reciprocating motion of the shaft results in continuous rotation of the fan panel 16' in successive 360° circular paths about the shaft. As the fan panel 16' moves through the circular path of rotation, a volume of air is pushed to create an air current through the air space surrounding the fan apparatus 10'.

Figure 7:
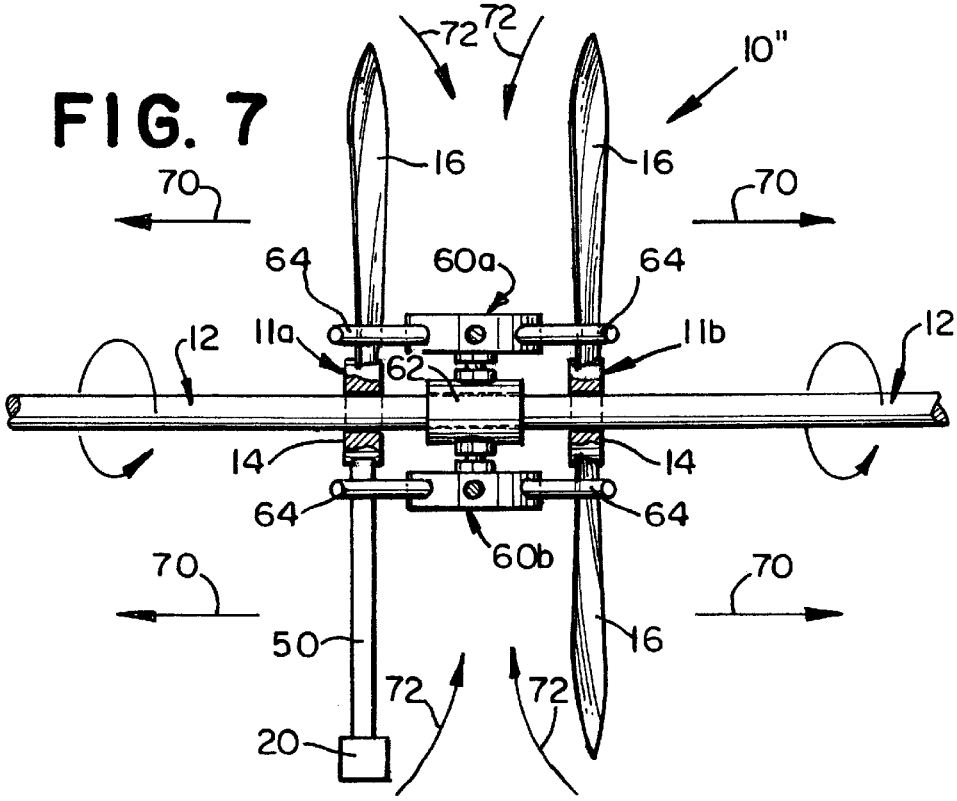
FIG. 7 is a top plan view of yet another embodiment of the fan apparatus of the present invention.
Figure 8:
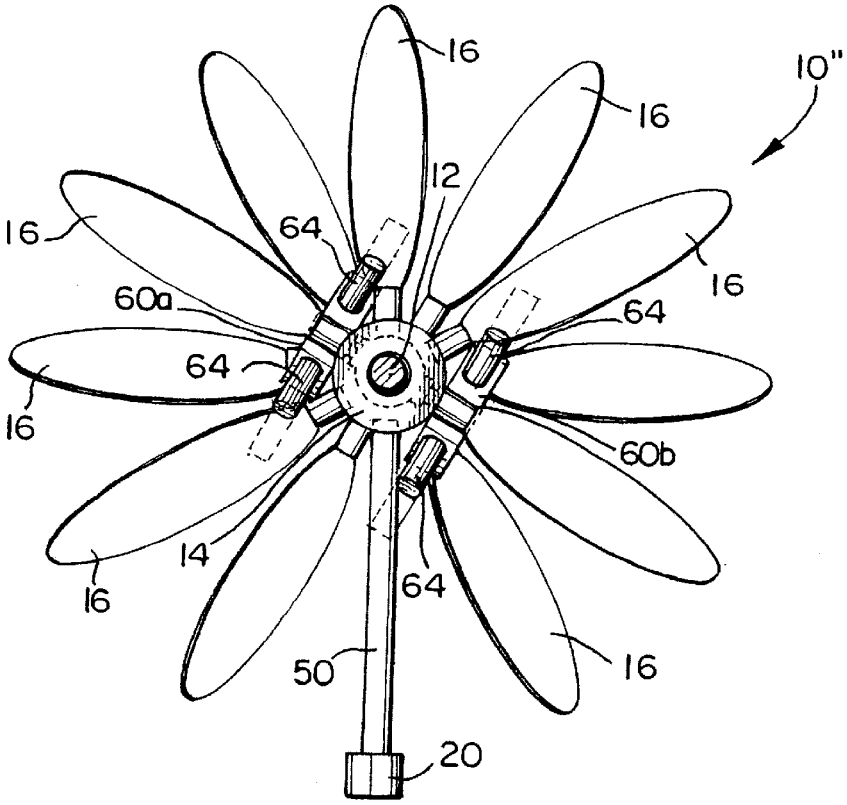
FIG. 8 is a side elevational view of the fan apparatus of FIG. 7.
Figure 9:
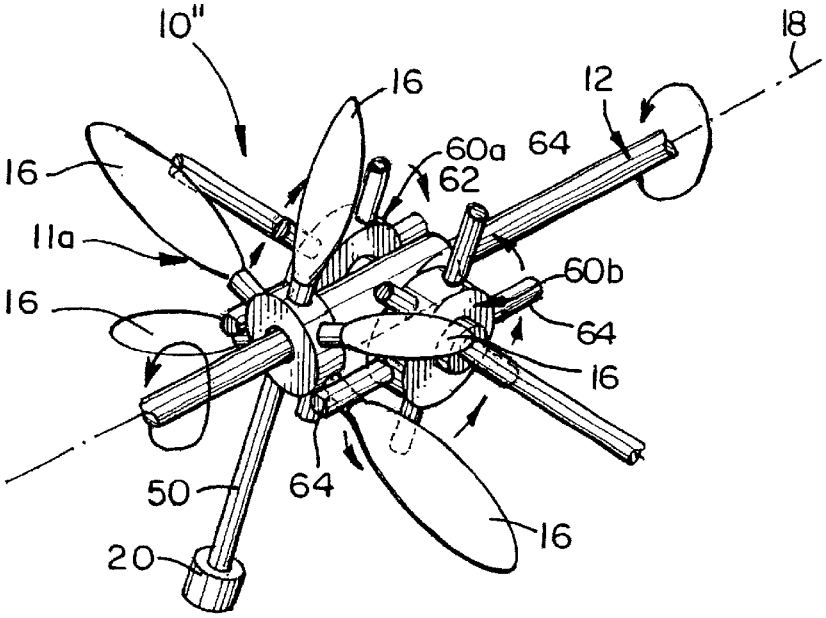
FIG. 9 is a top front perspective view of the fan apparatus of FIG. 7 with one hub and blade assembly removed for purposes of clarity.

Referring to FIGS. 7–9, another embodiment of the invention is shown, wherein a fan apparatus 10" includes two or more fan blade assemblies 11*a* and 11*b* supported on a main drive shaft 12. Each fan blade assembly 11*a*, 11*b* includes a hub 14 loosely fitted to the shaft 12 and rotatable thereabout in the twirling action described above. A plurality of fan blades 16 are fixed to each of the hubs 14 and extend radially outwardly therefrom, as best seen in FIG. 8. At least one of the fan blade assemblies 11*a* is provided with a weighted element 20 at the end of either one of the fan blades 16 or a radial spoke 50.

In accordance with the embodiment of FIGS. 7–9, the fan blade assemblies 11*a*, 11*b* are driven by a gear arrangement resembling a differential gear assembly. Specifically, first and second gear members 60*a* and 60*b* are rotatably fitted to a coupling 62. The coupling 62 is fitted to the shaft 12 so that the coupling and gear members 60*a*, 60*b* are maintained between the fan blade assemblies 11*a*, 11*b*. Pegs 64 extend radially from each of the gear members 60*a*, 60*b* to define gear teeth which are structured and disposed for intermeshing, driving engagement between the fan blades 16 on each of the hubs 14. In operation, the main drive shaft 12 is moved so that the central longitudinal axis of the drive shaft travels through the cyclical orbiting motion. As the drive shaft is moved in this motion, the weighted element is set in motion to generate angular momentum which drives fan blade assembly 11*a*. As the hub 14 and fan blades 16 of fan blade assembly 11*a* rotate, the intermeshing pegs 64 are engaged to drivingly rotate the gear members 60*a*, 60*b*. This in turn drivingly engages fan blade assembly 11*b* to rotate the hub 14 and fan blades 16 of fan blade assembly 11*b* in a rotational direction which is opposite to the rotational direction of fan blade assembly 11*a*. The fan blades 16 of each fan blade assembly 11*a*, 11*b* are specifically pitched to push air outwardly, in the opposite directions, as indicated by arrows 70 in FIG. 7. It is further noted that the gear members 60*a*, 60*b* may be structured and disposed to draw a current of air between the fan blade assemblies 11*a*, 11*b*, as indicated by arrow 72 in FIG. 7.

While the present invention has been shown and described in accordance with preferred and practical embodiments thereof, it is recognized that departures from the instant disclosure are contemplated within the spirit and scope of the present invention as defined in the following claims under the doctrine of equivalents.

What is claimed is:

1. A fan apparatus comprising:

a main drive shaft having a central longitudinal axis;

a hub coupled to said main drive shaft and freely rotatable relative to said main drive shaft, said hub being structured and disposed to move in a twirling action upon movement of said central longitudinal axis of said main drive shaft through an orbital path in a continuous, cyclical motion;

at least one fan blade attached to said hub and extending radially outward therefrom;

means for generating angular momentum to rotate said hub and carry said fan blade through a rotational path upon twirling of said hub; and said fan blade being structured and disposed to push a volume of air upon movement through said rotational path to thereby create a current of airflow.

2. The fan apparatus as recited in claim 1 wherein said means for generating angular momentum comprises:

a weight element supported radially outward of said hub and connected to said hub.

3. The fan apparatus as recited in claim 2 wherein said weight element is fixed to a distal end of said at least one fan blade.

4. The fan apparatus as recited in claim 1 further comprising:

a plurality of secondary fan blades attached to said hub and extending radially outward therefrom; and said plurality of secondary fan blades being structured and disposed to push said volume of air upon movement through said rotational path, thereby augmenting said current of airflow.

5. The fan apparatus as recited in claim 1 wherein said at least one fan blade is defined by a flat panel of flexible material.

6. The fan apparatus as recited in claim 1 further comprising:

a plurality of said hubs supported on said main drive shaft.

7. The fan apparatus as recited in claim 1 further comprising:

a primary fan blade assembly including said hub and said at least one fan blade;

at least one secondary fan blade assembly including said hub and said at least one fan blade; and means drivingly interconnecting said primary fan blade assembly to said at least one secondary fan blade assembly upon rotation of said hub and said at least one fan blade of said primary fan blade assembly about said main drive shaft.

* * * * *